United States Patent [19]

Brännström

[11] Patent Number: 4,722,182

[45] Date of Patent: Feb. 2, 1988

[54] POWER PLANT WITH COMBUSTION IN A FLUIDIZED BED

[75] Inventor: Roine Brännström, Finspong, Sweden

[73] Assignee: Asea Stal Aktiebolag, Västerås, Sweden

[21] Appl. No.: 915,468

[22] Filed: Oct. 6, 1986

[30] Foreign Application Priority Data

Oct. 7, 1985 [SE] Sweden ..... 8504636

[51] Int. Cl.[4] ..... F02C 3/26; F02C 7/26

[52] U.S. Cl. ..... 60/39.141; 60/39.464

[58] Field of Search ..... 60/39.141, 39.142, 39.464, 60/39.511; 110/244, 245, 263

[56] References Cited

U.S. PATENT DOCUMENTS 4,281,510 8/1981 Borjesgard et al. ..... 60/39.464
4,530,207 7/1985 Brannstrom ..... 60/39.464
4,584,949 4/1986 Brannstrom ..... 60/39.464
4,655,147 4/1987 Brannstrom et al. ..... 60/39.464

*Primary Examiner*—Louis J. Casaregola
*Attorney, Agent, or Firm*—Pollock, Vande Sande & Priddy

[57] ABSTRACT

A power plant designed to burn fuel in a bed of fluidizable particulate material contained in a combustion chamber includes a tubular discharge device for bed material or dust separated from combustion gases leaving the combustion chamber. The tubular discharge device is designed as a cooler which is cooled by combustion air flowing into the combustion chamber and is utilized for pre-heating the plant upon start-up from a cold state. At least a part of the tubular discharge device, is electrically insulated from parts located upstream and downstream and from supporting structural members and forms an electrical heating unit. Upon start-up, this unit is connected to a current source for heating the air fed to the combustion chamber and downstream parts of the plant.

5 Claims, 3 Drawing Figures

POWER PLANT WITH COMBUSTION IN A FLUIDIZED BED

TECHNICAL FIELD

The invention relates to a power plant for the combustion of fuel in a fluidized bed of a particulate material. For absorption of sulfur included in the fuel, the bed can contain a sulfur absorbent (e.g. lime or dolomite). The invention is applicable to plants operating close to atmospheric pressure and only producing heat as well as to plants operating at supra-atmospheric pressures and producing electricity.

BACKGROUND ART

For start-up of a cold fluidized bed combustion plant, it is known to provide special start-up combustion chambers by means of which the plant is heated up by the combustion gases. Water vapour in these gases may condense on any cold surfaces whose temperature is below that of the dew point. Any sulfur present in the fuel will form sulfur dioxide $SO_2$. In the presence of water, sulfuric acid $H_2SO_4$ is formed, so that any precipitated moisture becomes acidic and is highly corrosive. Dust which adheres to the moisture may become deposited on surfaces in gas cleaners and dust discharge systems provided and can cause clogging. To prevent the precipitation of moisture, a certain amount of heating may take place using dry gases from a special hot air boiler or by direct electric heating of those surfaces in the plant where moisture precipitation is likely to occur.

SUMMARY OF THE INVENTION

According to the present invention, at least a part of a pneumatic dust discharge system used for the removal of dust from a cleaning plant is employed as an electric heating element. Such a dust discharge system, which is utilized as a cooler for dust and transport gas is described, for example, in CIP U.S. application Ser. No. 563,427 (filed on the 20th Dec. 1983 in the name of Brännström and assigned to the assignee of this application) and is incorporated herein by reference. This dust discharge system may be positioned in a duct through which combustion air passes on its way to the combustion chamber.

By electrically heating tubes of the dust discharge system in this duct, dry air may be generated for heating metallic surfaces in a cold plant to such a temperature, for example to 150° C., so that continued heating by means of combustion gases from the combustion chamber on startup can take place without any risk of moisture precipitation arising on those metallic surfaces.

The tube parts utilized as electric heating elements in the dust discharge system can be mounted in the duct in such a way as to become electrically insulated from the surrounding structural members and from upstream and downstream tubes of the dust discharge system.

BRIEF DESCRIPTION OF THE DRAWINGS

The invention will be described in greater detail, by way of example, with reference to the accompanying drawings, wherein.

DESCRIPTION OF THE PREFERRED EMBODIMENT

Figure 1:
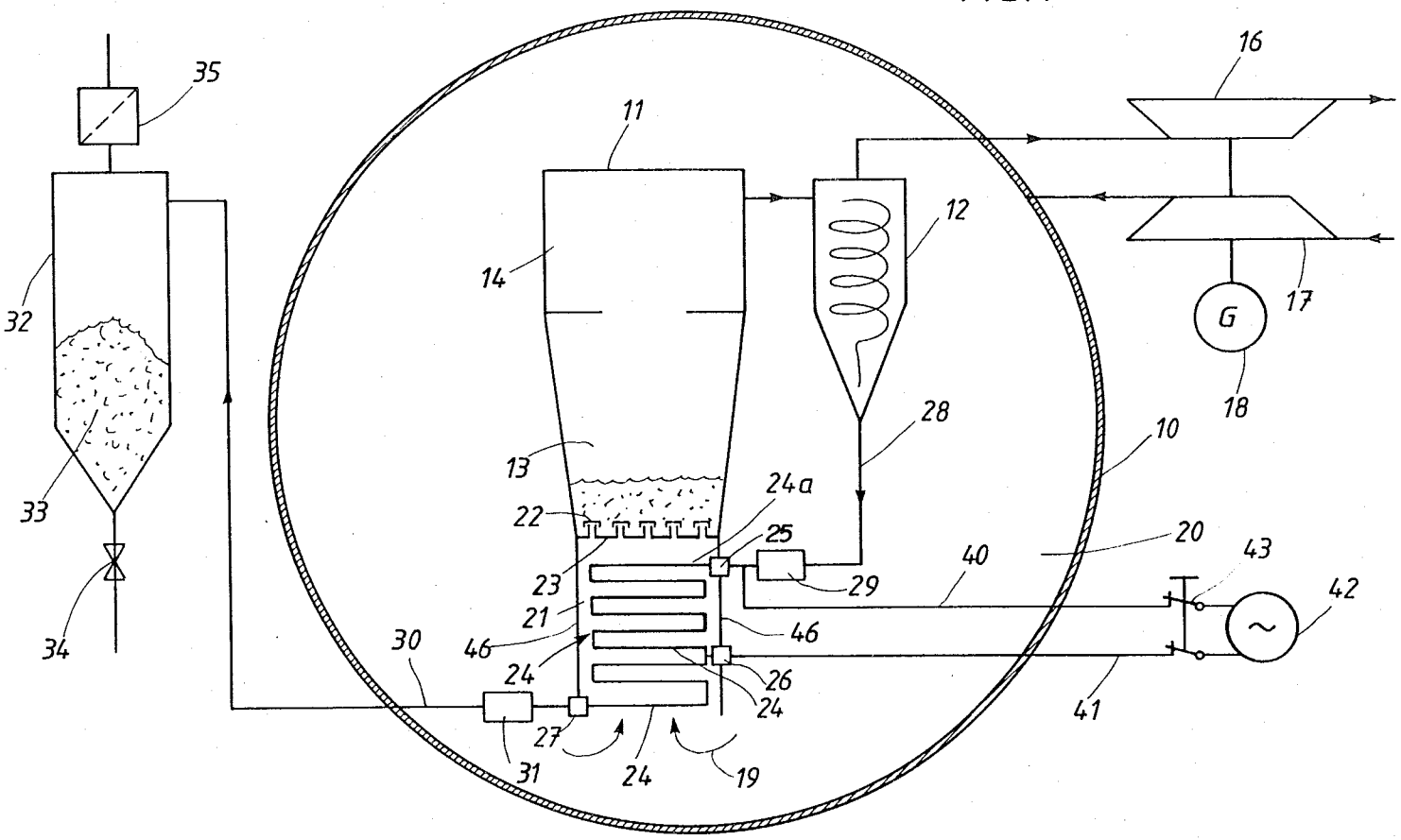
FIG. 1 shows schematically the present invention as applied to a PFBC power plant (PFBC being the initial letters of Pressurized Fluidized Bed Combustion)

In FIG. 1, 10 designates a pressure vessel, 11 a combustion chamber and 12 a cyclone type of gas cleaner. The combustion chamber 11 and the gas cleaner 12 are located inside the pressure vessel 10. The combustion chamber 11 includes a fluidizable bed 13, in which a fuel, supplied in a conventional manner not shown, is burnt. The combustion gases are collected in the volume 14 above the bed 13, are led to the cleaner 12, which usually comprise a number of parallel groups of series-connected cyclones, and further to a turbine 16. The turbine 16 drives a compressor 17 and an electrical generator 18. The compressor 17 feeds the space 20 in the pressure vessel 10. The generator 18 may be utilized as a starter motor.

Air 19 to sustain fuel combustion in the bed 13 is supplied thereto from the space 20 through a duct 21 and nozzles 22 provided in a bottom plate 23 of the furnace. In the duct 21 a pneumatic dust discharge device 24 is located which consists of a number of parallel tubes 24*a–x*, in which a pressure reduction is accomplished by periodic changes in direction of the dust-laden gas flow between the tubes. In the discharge device 24, the dust and its transport gas are cooled by the upwardly flowing combustion air. The tubes 24*a–x* in the discharge device 24 are attached by means of electrical insulating elements in a manner not shown. Insulating bushings 25, 26 and 27, respectively, for the tubes 24*a*, 24*x* and 24*y*, respectively, are provided in side walls 46 of the duct 21. The tube 24*a* is connected to an outlet conduit 28 from the cyclone cleaner 12 by means of a thermally insulating joint element 29. The tube 24*y* is connected to a conduit 30 by means of an electrically insulating bushing 27 and a thermally insulating joint element 31. The conduit 30 is connected to a collecting container 32 for dust 33. Collected dust 33 is removed through a valve 34 and transport gas is removed through a gas cleaner 35.

Figure 2:
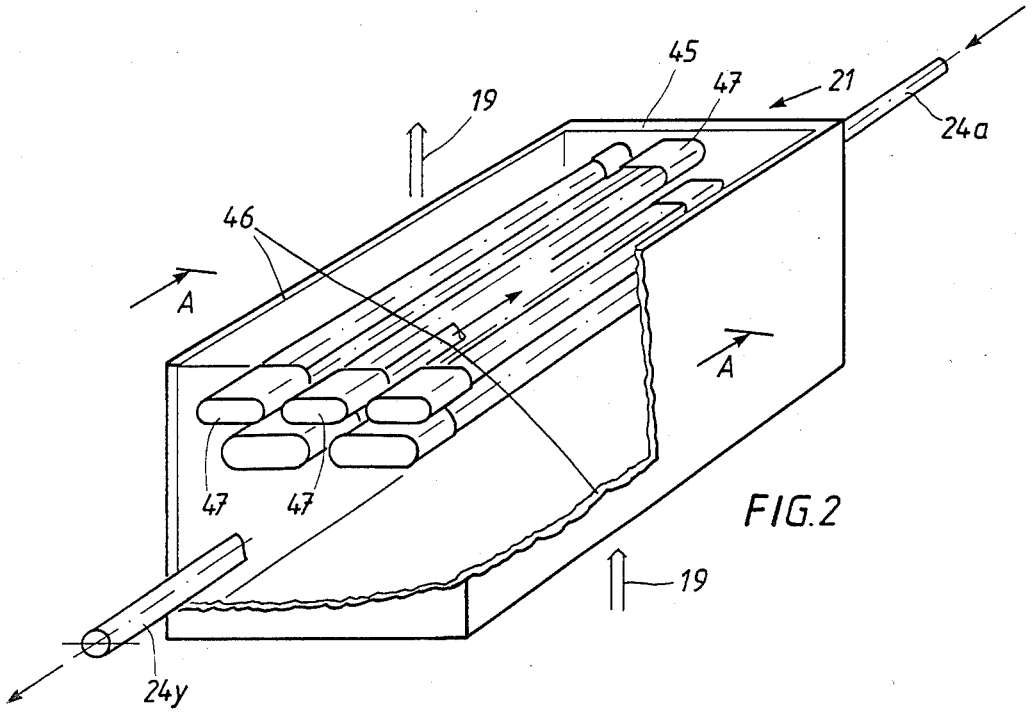
FIGS. 2 and 3 show schematically in perspective view and in cross section, respectively, a dust discharge system included in the plant of FIG. 1.
Figure 3:
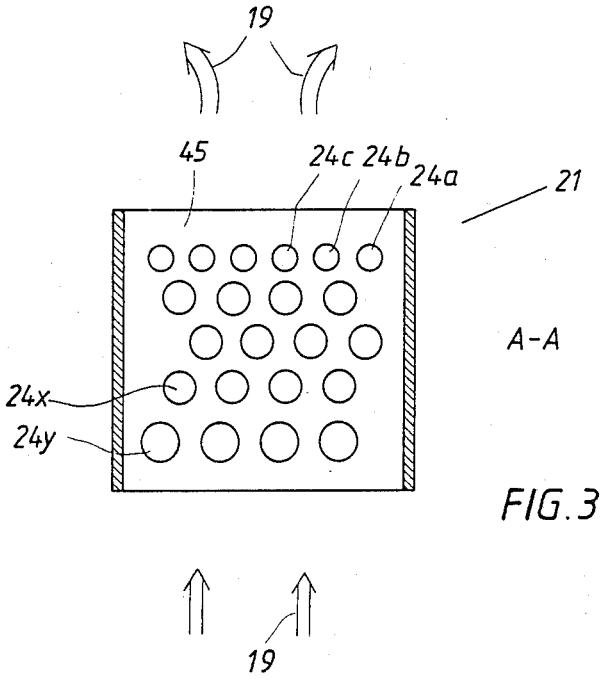

The duct 21 is defined in part by the side walls 46. The tubes 24 of the discharge device are connected consecutively in series by means of connection chambers 47 (see FIG. 2), where the gas/particle stream is diverted through 180° on passing from an upstream tube to the next adjacent downstream tube.

The entire discharge device 24, or, as shown, only a part thereof, may be utilized as an electric heating element. In the embodiment shown, the tubes 24*a* and 24*x* are connected by the conduits 40 and 41 to a source 42 of electric current through a switch 43.

Upon start-up a cold plant, the current source 42 is switched on. The area of the tubes 24 is large, so the requisite voltage will be low. This is advantageous because of the dust-rich environment. The generator 18 is employed as a motor and drives the turbine 16 and the compressor 17. Air supplied to the space 20 flows through the duct 21 and is heated by the discharge device 24, which is now utilized as a heating element. This air heats the combustion chamber 11, the bed 13 therein, the cleaner 12 and the turbine 16. The air is suitably heated to 200°–400° C. The necessary temperature of the tubes 24 may amount to 500°–700° C. Air flowing from the cyclone cleaner 12 through the electrically heated tubes 24*a*–24*x* is heated thereby. The heated air is subsequently cooled in the tubes 24x–24y so that the heat passes to the combustion air flowing up the duct 21 and is thus recovered. In this way the risk of harmful heating of the filter 35 is avoided.

After heating the plant to such a temperature that there will be no risk of condensation of combustion gases, the heating of the bed 13 to the required autoignition temperature by means of gas from the startup combustion chamber can be continued.

If the tubes 24 in the discharge device 21 are made of a highly refractory material, it is possible to heat the air flowing in the tubes 24a–24x to 700°–800° C., which is sufficient for heating the bed to the auto-ignition temperature of a suitable ignition fuel or even the principal fuel used in the bed.

The plant illustrated may be varied in many ways within the scope of the following claims.

I claim:

1. A power plant for the combustion of fuel in a fluidized bed of a particulate material comprising:

a combustion chamber, a compressor for pressurizing air for fluidizing the bed material and for providing combustion air to fuel supplied to the bed, a cleaning plant for receiving combustion gases from the combustion chamber and for the separation of dust from the combustion gases, a tubular pneumatic discharge device for separated dust, located in an air inlet duct between the compressor and the combustion chamber, wherein tubes forming the tubular discharge device are electrically conducting but are electrically insulated from the surrounding structural members and form a heating element heated by electric current, said heating element, upon start-up of a cold plant, being used for heating parts of the plant downstream of the discharge device by heating the fluidizing combustion air, so that the precipitation of moisture in said downstream parts of the plant is prevented upon start-up.

2. A PFBC power plant according to claim 1, in which the combustion chamber and cleaning plant are enclosed within a pressure vessel and are surrounded by compressed combustion air.

3. A PFBC power plant according to claim 2, in which the tubular pneumatic discharge device comprises a dust discharge system with a plurality of series-connected tube parts between which the gas-dust stream is diverted for successively reducing the pressure of the transport gas to atmospheric pressure.

4. A PFBC power plant according to claim 3, in which the plurality of tubes in the dust discharge device arranged in said air inlet duct are electrically insulated therefrom and from further tubes of the dust discharge device located upstream and downstream of said plurality of tubes in the dust discharge device.

5. A power plant according to claim 1, in which the tubes in an electrically heated part of the dust discharge device are made of a refractory material which permits heating of the tubes to such a temperature that they are capable of heating the bed material to the autoignition temperature of a fuel fed to the bed.

* * * * *